US007069855B2

(12) United States Patent
Fujiwara

(10) Patent No.: US 7,069,855 B2
(45) Date of Patent: Jul. 4, 2006

(54) PRINTING PRESS HAVING PLATE DISCHARGE DEVICE

(75) Inventor: Shigeo Fujiwara, Fuchu (JP)

(73) Assignee: Ryobi Ltd., Hiroshima-ken (JP)

( * ) Notice: Subject to any disclaimer, the term of this patent is extended or adjusted under 35 U.S.C. 154(b) by 0 days.

(21) Appl. No.: 11/159,729

(22) Filed: Jun. 23, 2005

(65) Prior Publication Data

US 2005/0284322 A1 Dec. 29, 2005

(30) Foreign Application Priority Data

Jun. 25, 2004 (JP) ..... 2004-188021

(51) Int. Cl.
*B41L 31/00* (2006.01)
*B41L 47/14* (2006.01)

(52) U.S. Cl. ..... 101/477; 101/415.1

(58) Field of Classification Search ..... 101/477, 101/415.1, 479, 480, 378, 216
See application file for complete search history.

(56) References Cited

U.S. PATENT DOCUMENTS 6,892,641 B1 * 5/2005 Aoki ..... 101/477

FOREIGN PATENT DOCUMENTS

| | | |
|---|---|---|
| JP | 05-026374 U | 4/1993 |
| JP | 07-290690 | 11/1995 |
| JP | 2844231 B | 10/1999 |
| JP | 3066614 B | 5/2000 |

* cited by examiner

*Primary Examiner*—Leslie J. Evanisko
(74) *Attorney, Agent, or Firm*—The Webb Law Firm

(57) ABSTRACT

A printing press which can limit increase in the entire size of a plate discharge device while moving a printing plate in a plate discharge direction by a sufficient distance is provided. The plate discharge device is provided with a cylinder device. A first clamping roller is mounted via a pinion to a mounting member mounted to a rod of the cylinder device. A rack is disposed to be meshed with the pinion. A second clamping roller is provided to the mounting member so as to be movable closer to and away from the first clamping roller via a switching means.

4 Claims, 9 Drawing Sheets

PRINTING PRESS HAVING PLATE DISCHARGE DEVICE

CROSS REFERENCE TO RELATED APPLICATION

This application claims priority from Japanese Patent Application No. 2004-188021, which is incorporated herein by reference.

BACKGROUND OF THE INVENTION

1. Field of the Invention

The present invention relates to a printing press and more particularly a structure of a printing section disposed between a sheet feeding section and a sheet discharge section so as to supply a printing plate to a clamping gripper that is mounted on a plate cylinder and mount the same on the plate cylinder.

2. Related Art

A sheet-fed printing press (hereinafter referred simply to a printing press) generally includes a printing section between a sheet feeding section and a sheet discharge section. This printing section is to print on sheets by a printing plate mounted on a plate cylinder. The printing press is generally equipped with a printing plate mounting device that automatically mounts a printing plate, which has been manually inserted into a clamping gripper mounted on the plate cylinder. According to a recently proposed printing press, an automatic supply mechanism is employed to automatically supply a printing plate (a new plate), which has been once set at a predetermined position by an operator, to a clamping gripper.

Also, there is another type of a printing press equipped with a plate discharge device that discharges a printing plate (used plate) in a plate discharge direction after the finish of the printing operation. For example, Japanese Patent No. 2844231 proposes a plate discharge device, in which a printing plate is held at a trailing edge in engagement with a plate hook within a loader; this plate hook is connected to a blade spring wound around a convex so that the printing plate is pulled out in the plate discharge direction by a spring restoring force of the blade spring. In this plate discharge device, the plate hook is disposed so as to be pivotally moved around a support shaft so as to be urged against a guide wall of the loader by a coil spring, taking an upright position when not in a plate discharge operation. When in a plate discharging operation, a separately provided cylinder device is driven so as to allow its rod to press the plate hook that is in turn pivotally moved away from the guide wall to take a tilting position, forming a space with respect to the guide wall, into which a trailing edge of the printing plate is insertable. As the plate cylinder rotates, the trailing edge of the printing plate is inserted between the plate hook and the guide wall. Then, the plate hook is pivotally moved to again take the upright position by releasing pressure of the cylinder device therefrom, allowing the trailing edge of the printing plate to be held by the plate hook. At this moment, the printing plate is interposed between the plate hook and the guide wall so that the plate hook no longer engages with the guide wall and hence is pulled out in the plate discharge direction by a spring force of the blade spring. In this device, it is possible to pull out a printing plate by a sufficient distance in the plate discharge direction, depending on the distance between the convex and the position at which the plate hook is mounted.

According to the above conventional plate discharge device of the printing press, it is possible to pull out a printing plate by a sufficient distance in the plate discharge direction. However, this plate discharge device, which has the convex with the blade spring wound therearound, the plate hook, the coil spring for holding the plate hook in the upright position, a cylinder device for pressing the plate hook, and a means for allowing the plate hook to be urged against the guide wall, causes the entire device to have a complicated structure. In order to address this problem, it may be conceivable to provide a relatively simple structure with rollers for clamping the trailing edge of a printing plate, in which these rollers are moved in the plate discharge direction by the use of a cylinder device, thus achieving the discharge of the printing plate. However, in order to move the printing plate in the plate discharge direction by a sufficient distance, it is necessary to provide a cylinder device having a long stroke, which may lead to increase in the entire size of the device. Increase in the entire size of the device poses a problem to close the downstream side of an ink fountain provided adjacent thereto, and hence deteriorate the performance to operate the ink fountain such as in feeding ink, cleaning and maintenance operations.

It is an object of the present invention to provide a printing press that is capable of pulling out a printing plate in the plate discharge direction by a sufficient length while limiting the increase of the entire size of the plate discharge device.

SUMMARY OF THE INVENTION

According to the present invention, there is provided a printing press with a plate cylinder, on which a printing plate is to be mounted. The printing press includes a clamping gripper being provided on the plate cylinder so as to clamp an edge of the printing plate, and a plate discharge device for moving the printing plate in a plate discharge direction with a trailing edge of the printing plate as a leading edge after the printing plate is released from a clamped relationship with the clamping gripper. The plate discharge device includes: a plate guide member for forming a plate discharge passage in the plate discharge direction; a transfer member disposed along the plate discharge passage for being brought into contact with a printing plate, which has been released from the clamped relationship with the clamping gripper, so as to transfer the printing plate in the plate discharge direction; an extendable device for reciprocatingly moving the transfer member along the plate guide member through the length of the reciprocating stroke thereof, and a moving distance addition means for allowing the printing plate, which is kept in contact with the transfer member, to be moved in the plate discharge direction through a distance obtained by adding a given distance to the distance corresponding to the length of the reciprocating stroke of the extendable device.

With the thus arranged printing press, as the moving distance of the printing plate in the plate discharge operation, a given distance obtained by the moving distance addition means is added to the distance corresponding to the length of the reciprocating stroke of the extendable device. Therefore, it is possible to increase the moving distance of the printing plate in the plate discharge operation without the necessity to enlarge the size of the extendable device, and achieve ease of the plate discharging operation even with a plate discharge device having a simple structure.

It is preferable to make up the transfer member by the use of a pair of clamping rollers for claiming the printing plate from the opposite sides thereof, and to further include a shifting means for shifting the clamping rollers between a plate insertion position at which the clamping rollers are moved away from each other to allow the printing plate to be inserted therebetween, and a clamping position at which the clamping rollers are moved closer to each other to clamp the printing plate therebetween, along the reciprocating stroke of the extendable device.

With the above arrangement, the printing plate, which has been released from the clamped engagement with the clamping gripper, is inserted between the clamping rollers shifted to the plate insertion position by the shifting means, then clamped by these clamping roller, and moved in the plate discharge direction through a distance obtained by adding a given distance to the distance corresponding to the length of the reciprocating stroke of the extendable device. As a result, it is possible to transfer the printing plate in the plate discharge direction by a sufficient distance.

The moving distance addition means is preferably made up of a pinion that is rotatably connected to an extendable part of the extendable device and a rack that is disposed in meshed engagement with the pinion, in which at least one of the clamping rollers is disposed to be rotatable integrally with the pinion. With this arrangement, the pinion is rotated along with the reciprocating stroke of the extendable device, and the clamping rollers are rotated by the rotational force of this pinion, so that the printing plate is moved by a distance not equal to the distance corresponding to the length of the reciprocating stroke of the extendable device, but a distance equal to the sum of this distance of the extendable device and the linear distance corresponding to the rotational distance of the clamping rollers.

According to the printing press of the present invention, the moving distance addition means is provided to allow the printing plate to be moved through a distance obtained by adding a given distance to the distance corresponding to the length of the reciprocating stroke of the extendable device. With this moving distance addition means, it is not necessary to secure a sufficient length of the reciprocating stroke by enlarging the size of the extendable device itself exclusively for this purpose, while making it possible to move the printing plate by a sufficient distance. Since increase in the entire size of the device can be limited, it is possible to avoid such a state where the downstream side of the ink fountain is closed, and therefore prevent deterioration of the performance to operate the ink fountain.

BRIEF DESCRIPTION OF THE DRAWINGS

The above, and other objects, features and advantages of the present invention will become apparent from the detailed description thereof in conjunction with the accompanying drawings wherein.

DETAILED DESCRIPTION OF THE PREFERRED EMBODIMENT

Figure 1:
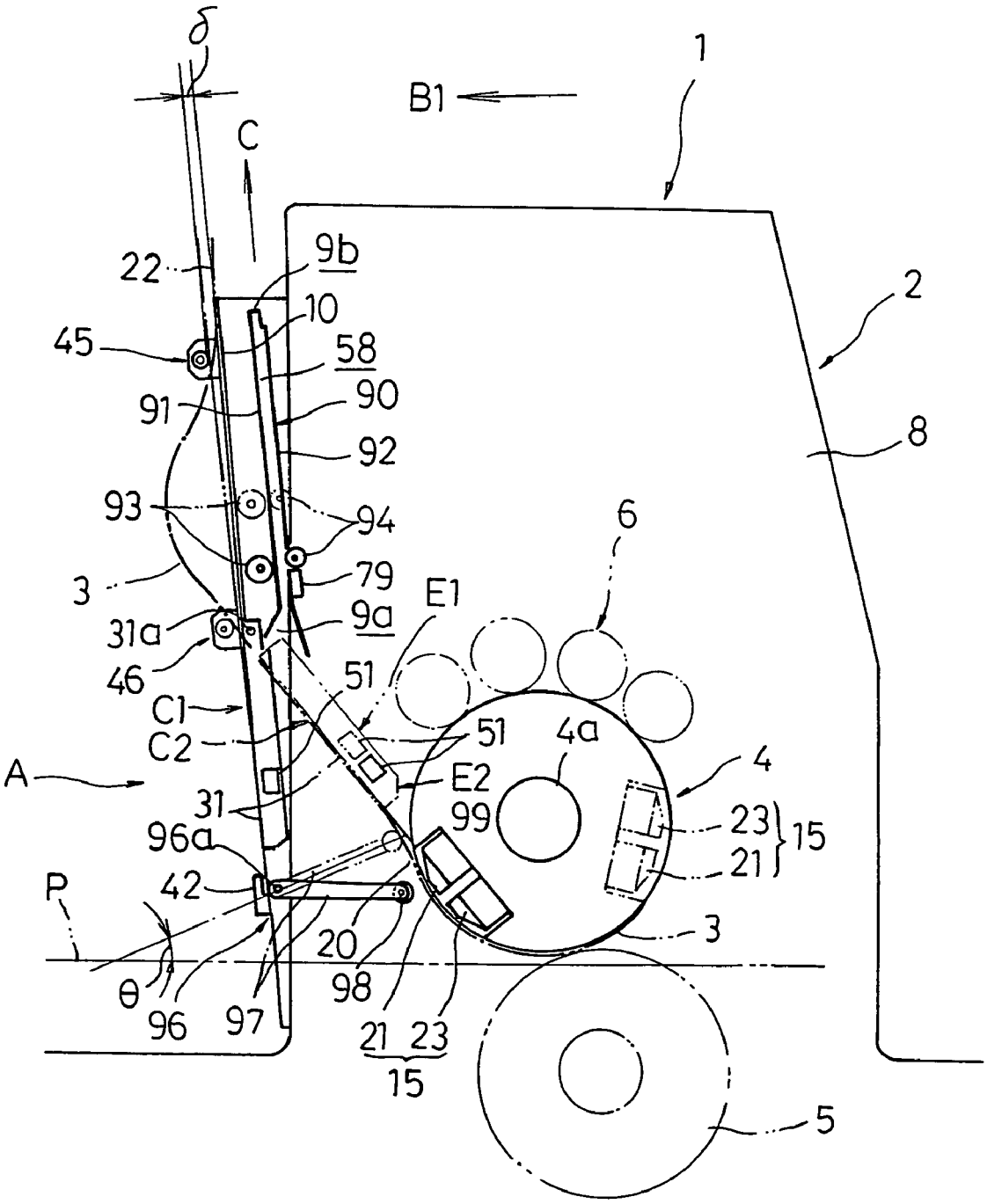
FIG. 1 is a schematic cross sectional view illustrating the motion of a printing press in a plate supply operation, according to an embodiment of the present invention.
Figure 2:
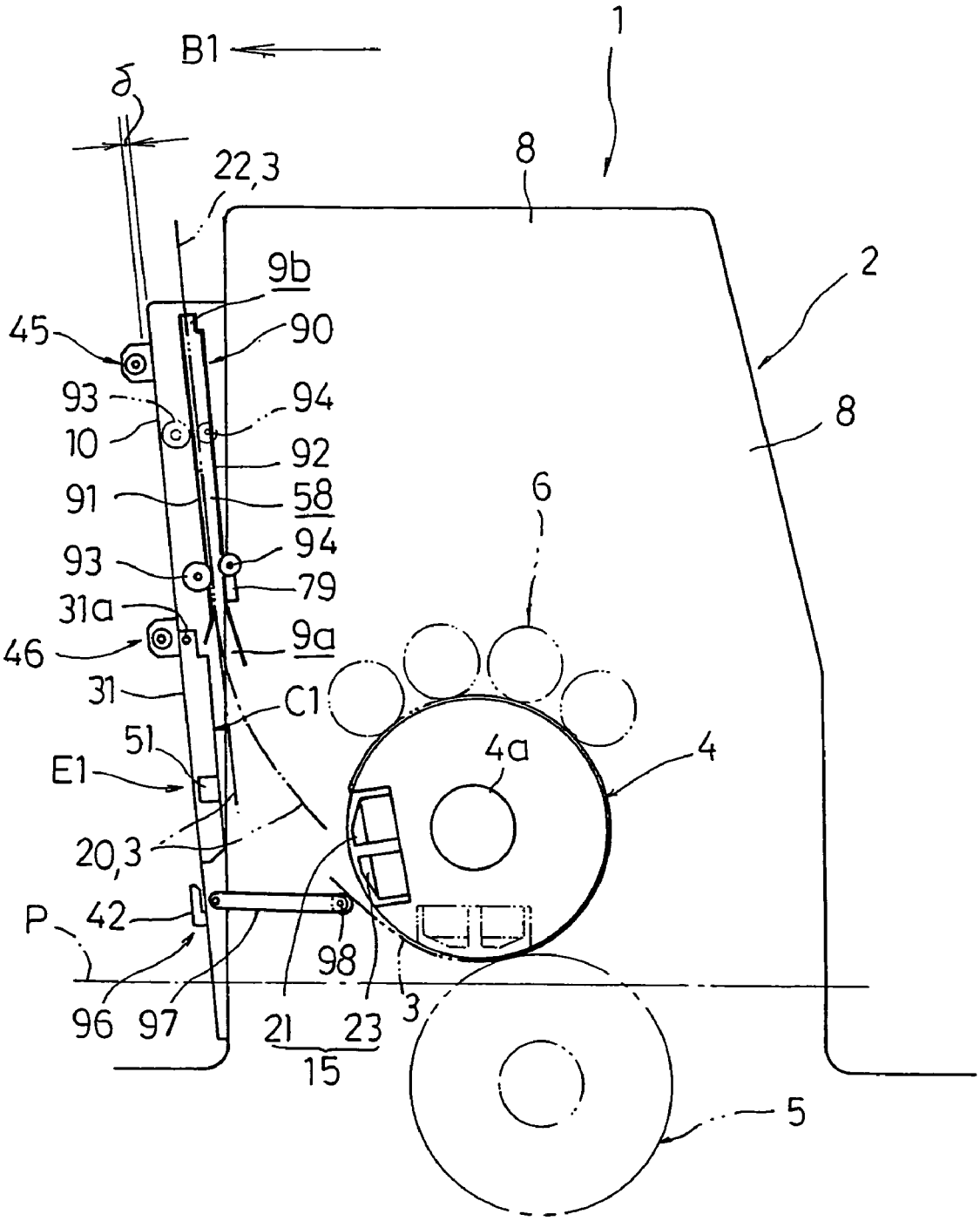
FIG. 2 is a schematic cross sectional view illustrating the motion of the printing press in a plate discharge operation.
Figure 3:
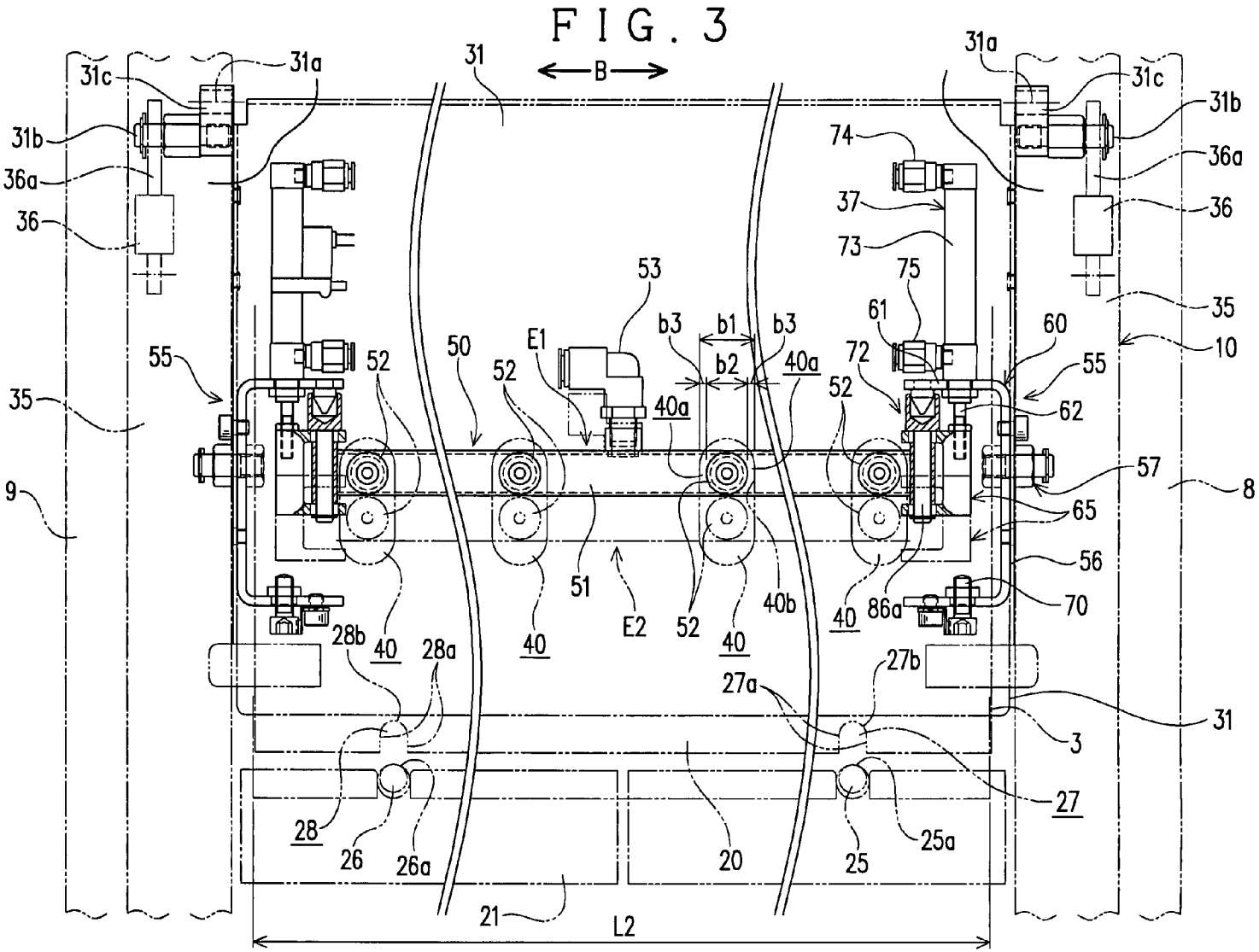
FIG. 3 is a rear view of a printing plate guide plate with a plate supply device of the printing press.
Figure 4:
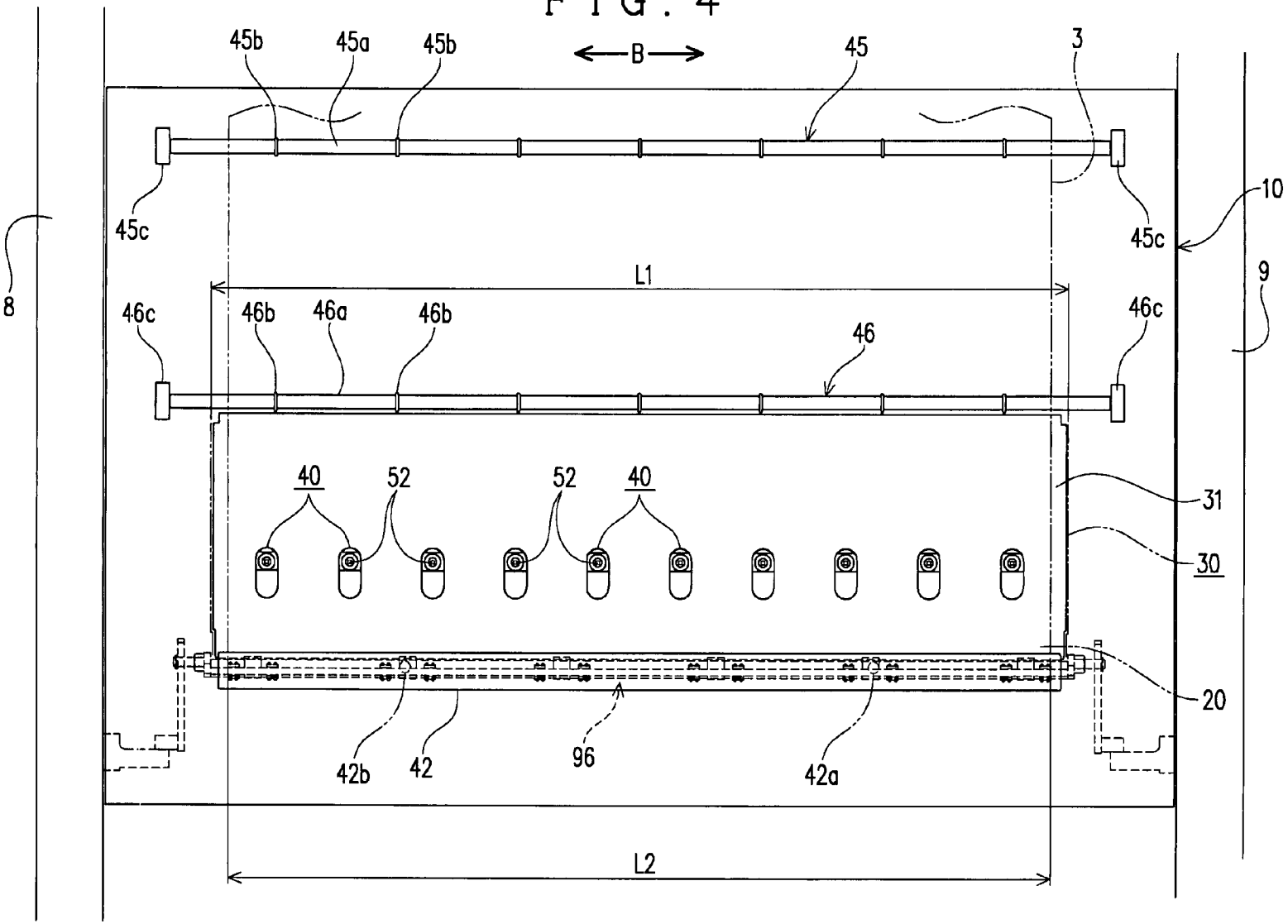
FIG. 4 is a front view of a downstream sided front panel of the printing press.
Figure 5:
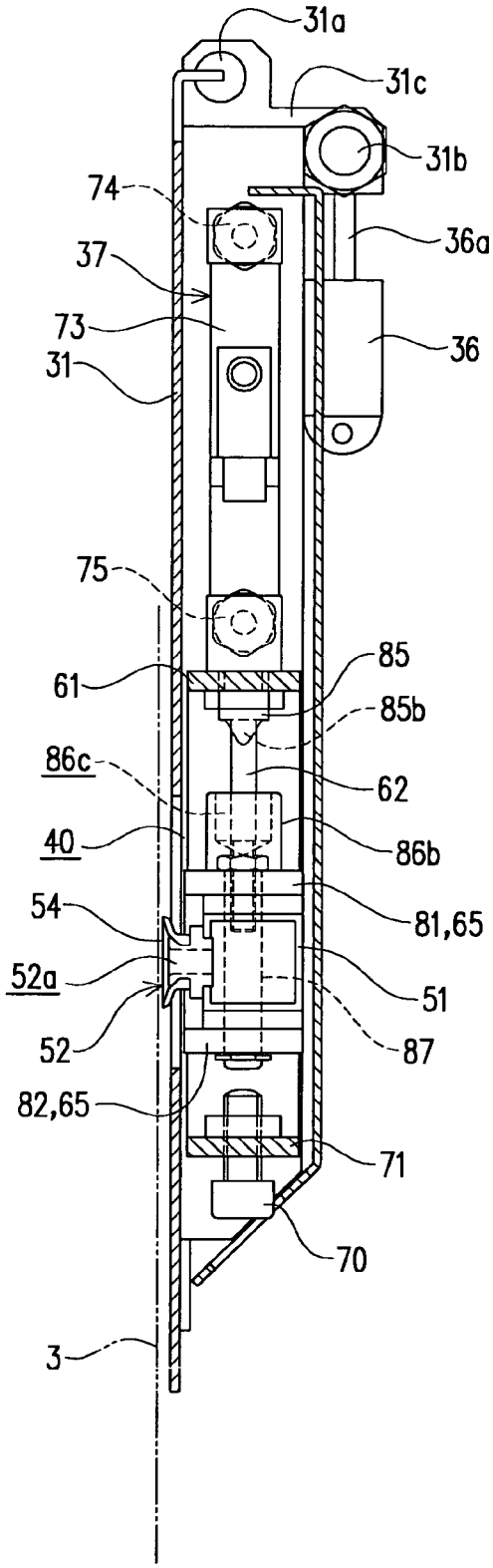
FIG. 5 is a lateral cross sectional view of the downstream sided front plate with the plate supply device.
Figure 6:
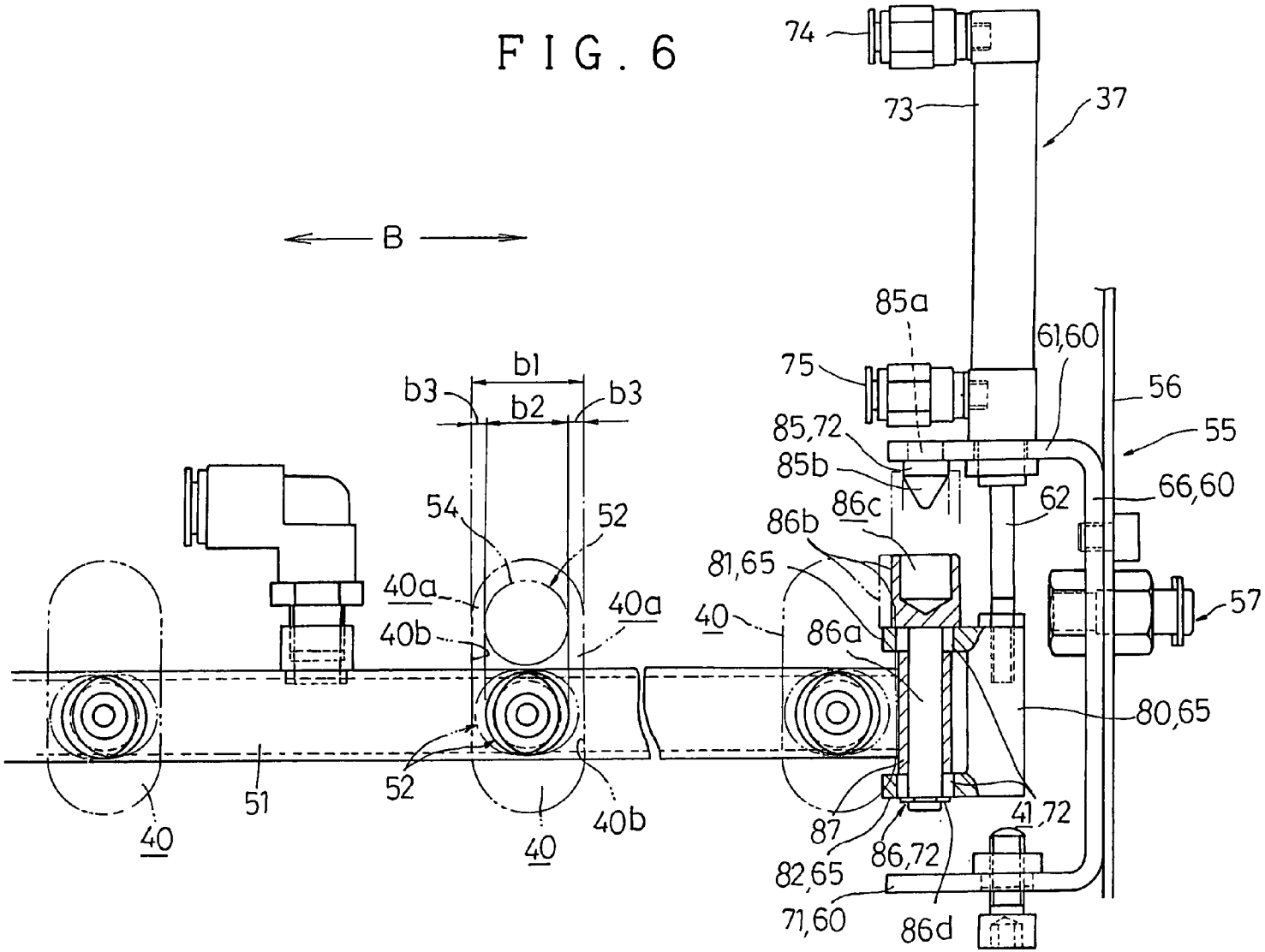
FIG. 6 is an enlarged view of the plate supply device with a partly broken-out section.
Figure 7:
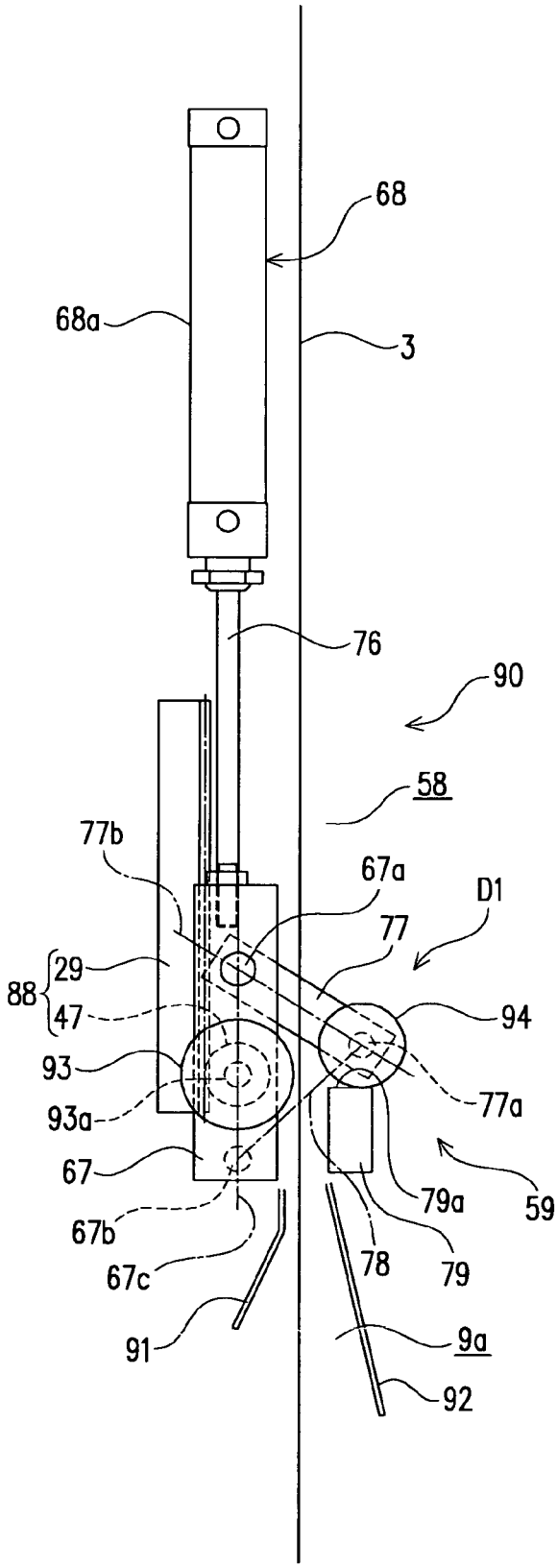
FIG. 7 is an operational view illustrating a plate insertion position of clamping rollers of the plate discharge device.
Figure 8:
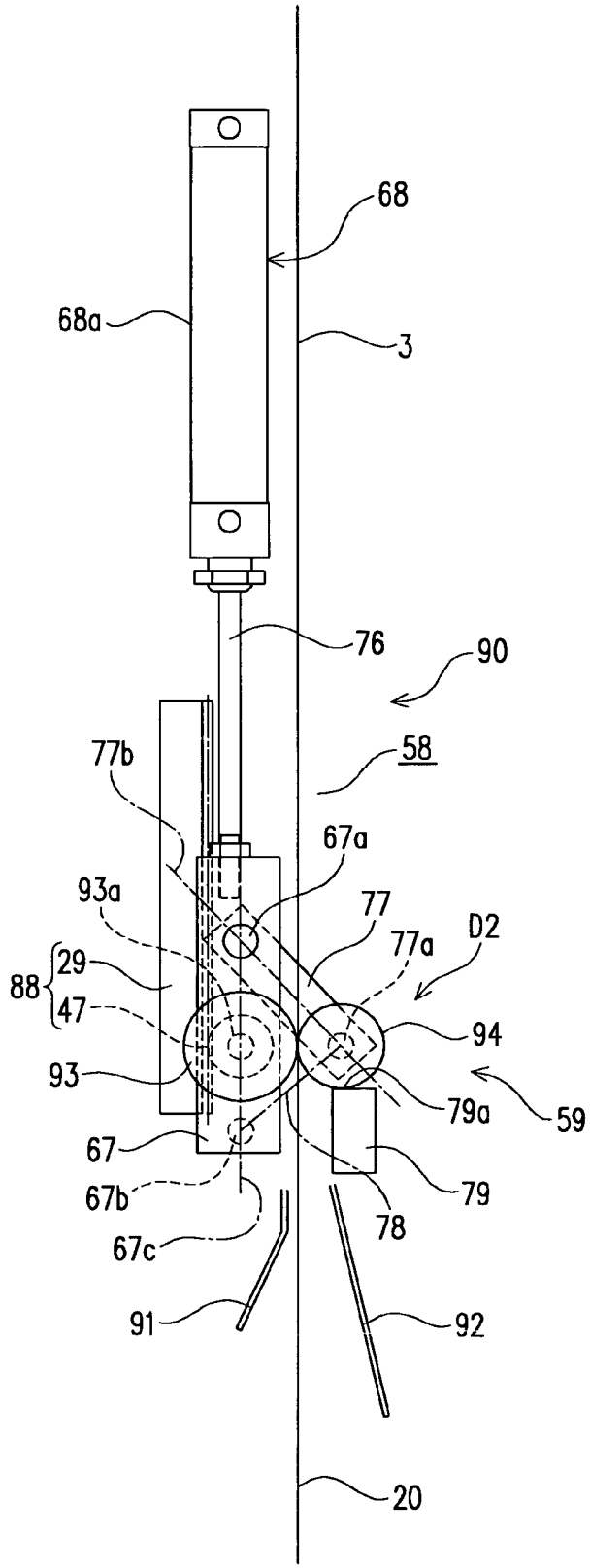
FIG. 8 is an operational view illustrating a clamping position of the clamping rollers of the plate discharge device.
Figure 9:
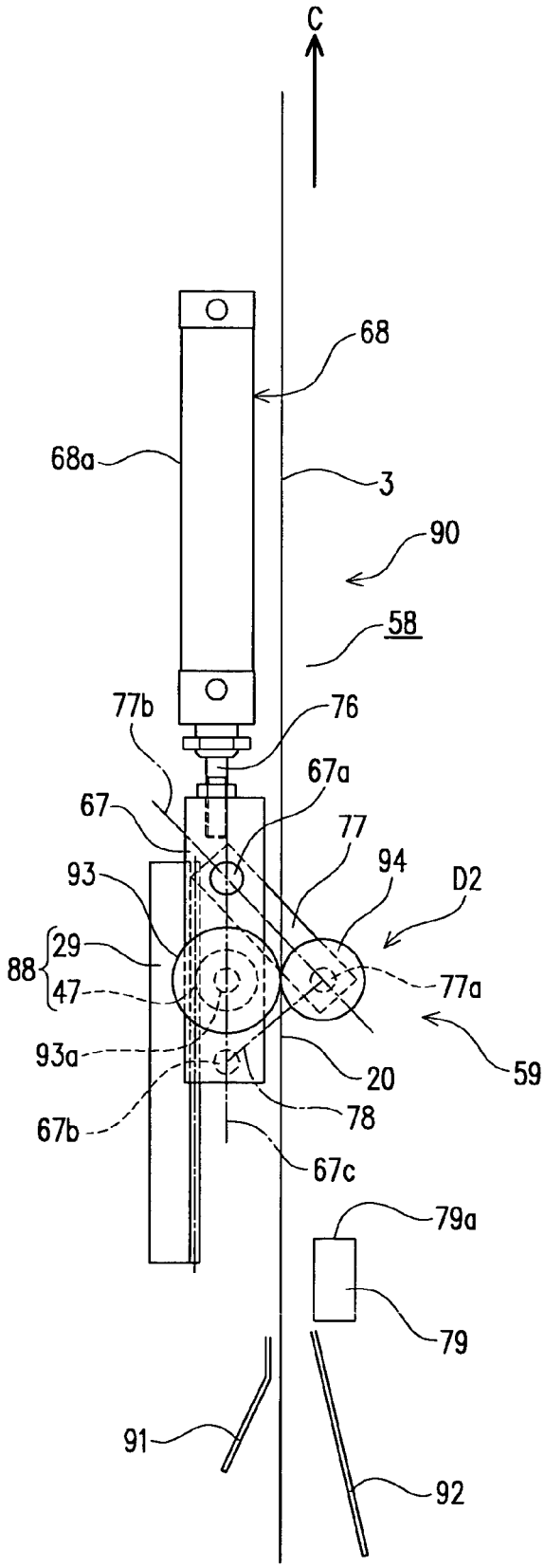
FIG. 9 is an operational view at the time of the finish of the plate discharge operation by the plate discharge device.

Now, the description will be made for an embodiment of a printing press by taking for example a sheet-fed printing press with reference to the drawings attached hereto. FIGS. 1 and 2 are schematic lateral cross sectional views of a printing section of a sheet-fed printing press. FIG. 3 is a rear view of a printing plate guide plate illustrating the structure of a plate supply device. FIG. 4 is a front view of a downstream sided front plate. FIG. 5 is a lateral cross sectional view illustrating the structure of the plate supply device. FIG. 6 is an enlarged view of a partly broken-out section of FIG. 3. FIGS. 7–9 are operational views of the plate discharge device.

Generally, a sheet-fed printing press has a sheet feeding section on the upstream side, a sheet discharge section on the downstream side and a printing section (also called as a printing unit) therebetween. All the Figures attached hereto illustrate the structure of a printing section 1. In this embodiment, only the single printing section 1 is illustrated for ease of explanation, although plural numbers of printing sections are to be set out between the sheet feeding section and the sheet discharge section according to the number of ink colors to be used for printing.

As illustrated in FIGS. 1 and 2, the printing section 1 includes a body cover 2, a plate cylinder 4 disposed inside of the body cover 2 for mounting of a printing plate 3 thereon, an inking device with plural ink rollers 6 for supplying ink to the plate cylinder 4, and a plate supply device A for supplying a printing plate to the plate cylinder 4. The plate cylinder 4 is rotatably supported by opposite lateral plates 8, 9 via a support shaft 4*a*. A reference numeral 5 represents a rubber cylinder (a blanket cylinder) to be held in contact with the plate cylinder in a rotatable manner.

The body cover 2 includes a downstream sided front panel 10 disposed on a downstream side B1 between the opposite lateral plates 8, 9. The downstream sided front panel 10 is mounted between the opposite lateral plates 8, 9 in such a manner as to be movable in the vertical direction, thereby enabling closing and opening of the downstream side B1 between the opposite lateral plates 8, 9.

The plate cylinder 4 includes a known clamping gripper 15 for gripping the printing plate 3, which includes a leading-edge clamping member 21 for gripping a leading edge 20 (as a gripper receiving edge) of the printing plate 3 and a trailing-edge clamping member 23 for gripping a trailing edge 22 of the printing plate 3, both members being disposed in pair in the circumferential direction. As illustrated in FIG. 3, the leading-edge clamping member 21 has a pair of protrusions 25, 26 each having a cylindrical column shape disposed with a given distance from each other in an axial direction B of the plate cylinder 4 (hereinafter referred to a width direction B). The leading edge 20 of the printing plate 3 forms cutouts 27, 28 for engagement with the protrusions 25, 26. At least one of the cutouts 27, 28 has a bottom wall 27*b* or 28*b* of a semi-circular shape having a curvature substantially corresponding to a curvature of an outer circumference 25*a* or 26*a* of the protrusion 25 or 26, and lateral side walls 27*a*, 28*a* extending straightforward from the opposite ends of each of the bottom walls 27*b*, 28*b*.

As illustrated in FIGS. 3 and 4, the downstream sided front panel 10 has a lower portion forming an opening 30 of a rectangular shape for insertion of the printing plate 3. The plate supply device A has a printing plate guide plate 31 for opening and closing the opening 30. The printing plate guide plate 31 has a width L1 greater than a width L2 of the printing plate 3. The printing plate guide plate 31 is pivotally movably mounted via a support shaft 31*a* extending between the opposite lateral portions of the rear side of the downstream sided front panel 10. The downstream sided front panel 10 has lateral portions 35 to which cylinder devices 36 are pivotally movably mounted so as to shift the printing plate guide plate 31 between a printing plate setting position C1 at which the opening 30 is closed with the guide plate 31 and a printing plate supply position C2 at which the guide plate 31 is pivotally moved towards the clamping gripper 15. A leading end of a rod 36*a* of each cylinder device 36 is mounted to an operation shaft member 31*b* parallel to the width direction B so as to control the position of the printing plate guide plate 31. This operational shaft member 31*b* is connected via a connection member 31*c* to a support shaft 31*a* that extends parallel to the width direction, around which support shaft 31*a* the printing plate guide plate 31 is pivotally moved. The support shaft 31*a* is pivotally movably mounted to a corresponding one of the lateral portions 35 of the downstream sided front panel 10. The printing plate guide plate 31 is pivotally moved integrally with the support shaft 31*a* via the connection members 31*c* by moving forward and backward the rods 36*a* upon driving of the cylinder devices 36 so as to be shifted between the printing plate setting position C1 and the printing plate supply position C2. A plate surface of the printing plate guide plate 31 has plural elongated holes 40 extending along the plate surface in a direction orthogonal to the width direction B (hereinafter referred to a vertical direction) and aligned to each other in the width direction B.

The plate supply device A has on the front side of the downstream sided front panel 10 a receiving frame member 42 having a length substantially equal to the width of the printing plate guide plate 31 and located downstream of a lower edge of the opening 30 in an overlapping manner therewith. The receiving frame member 42 has on the side facing the printing plate guide plate 31 a pair of positioning members (protrusions 42*a*, 42*b*) that are engageable with portions (cutouts 27, 28) of the printing plate 3, through which the printing plate 3 is supported in position. Provided between the lower portion of the printing plate guide plate 31 and the receiving frame member 42 is a clearance for allowing the insertion of the leading edge 20 of the printing plate 3 when the opening 30 is closed with the printing plate guide plate 31. A pair of printing plate guide rods 45, 46, which are located in parallel above and below each other, are rotatably mounted via brackets 45*c*, 46*c* on the front upper portion of the downstream sided front panel 10, both rods being greater in length than the printing plate 3 in the width direction B. These printing plate guide rods 45, 46 are disposed with a given distance in the vertical direction, each having a clearance of a distance δ allowing for passing of the printing plate 3 therethrough from the front side of the downstream sided front panel 10. The printing plate guide rods 45, 46 each have large diameter portions 45*b*, 46*b*, which are slightly greater in diameter than ordinary diameter portions 45*a*, 46*a* between the opposite ends of the printing plate guide rods 45, 46.

The plate supply device A has a sucker 50 for sucking a rear side of the printing plate 3 and holding the printing plate 3. The sucker 50 is disposed on the rear side of the printing plate guide plate 31. The sucker 50 includes a suction pipe 51 having a length smaller than the printing plate guide plate 31 in the width direction and plural suction nozzles 52 protruding forward from the suction pipe 51 so as to be respectively inserted into the elongated holes 40. This sucker 50 is shiftable between a suction position E1 allowing the suction nozzles 52 to be held at the upper portions of the corresponding elongated holes 40 and suck the printing plate 3, and a plate supply position E2 allowing the suction nozzles 52 with the printing plate 3 sucked therewith to be held at the lower portions of the corresponding elongated holes 40, that is, held close to the clamping gripper 15. The suction pipe 51 with opposite ends closed is connected to a suction pump (not shown) via a suction joint 53 connected to a middle portion of the suction pipe 51.

As illustrated in FIG. 5, the suction nozzles 52 are mounted to the suction pipe 51 so as to respectively have nozzle ports 54 slightly protruding forward from the printing plate guide plate 31, and each have at its center a suction hole 52*a* for communication with the suction pipe 51. As illustrated in FIG. 6, a width b1 of each elongated hole 40 is larger than a maximum diameter b2 of the nozzle port 54 of the corresponding suction nozzle 52, so that clearances 40*a* each having a width b3 are provided between opposite circumferential walls 40*b* of the elongated hole 40 and the nozzle port 54.

A pair of support devices 55 are provided to support the suction pipe 51, allowing the suction pipe 51 to be reciprocated in the vertical direction, and allowing the same to be reciprocated along the plate surface of the printing plate guide plate 31 in the width direction B. The pair of support devices 55 are mounted at the opposite ends of the sucker 50 in the width direction B on the rear side of the printing plate guide plate 31. The both support devices 55 have an identical structure, and therefore the description will be made only for one of the support devices 55. The support device 55 includes a bracket 60 fixed to a bent plate portion 56, which is formed by bending a lateral portion of the printing plate guide plate 31*a*, with a fixing means 57 in the form of a bolt and a nut, a cylinder device (air cylinder device) 37 fixed to an upper plate portion 61 of this bracket 60, a support block 65 fixed to a leading end of a rod 62 of the cylinder device 37, and a block positioning mechanism 72 provided to the support block 65 and the upper plate portion 61 of the bracket 60.

The bracket 60 has a mounting portion 66 for allowing itself to be fixed to the bent plate portion 56 via the fixing means 57, the upper plate portion 61 formed by bending an upper part of the mounting portion 66, and a lower plate portion 71 formed on the lower part of the mounting portion 66 and having a stopper 70 (hereinafter described), thus forming a reversed C-shape with its left-hand side opened when viewed from the front side. The cylinder device 37 is designed to allow the rod 62 to be vertically reciprocated by having a cylinder portion 73 fixed to the upper plate portion 61 in the vertical direction. Air supply joints 74 and 75 are provided on the lateral sides of the opposite longitudinal ends of the cylinder portion 73.

The support block 65 has a dimension smaller than the height in the lengthwise direction of the mounting portion 66 of the bracket 60 and disposed between the upper plate portion 61 and the lower plate portion 71. This support block 65 has a body 80 fixed to the leading end of the rod 62, and support pieces 81, 82 respectively disposed on the opposite sides of the body 80 in the lengthwise direction (vertical direction), substantially parallel to the upper and lower plate portions 61, 71, thus forming a reversed C-shape with its left-hand side opened when viewed from the front side. The stopper 70 is disposed opposite to the body 80 of the support block 65 in the lengthwise direction so as to have an upper end protruding upward from the lower plate portion 71 towards the body 80 of the support block 65.

The block positioning mechanism 72 has a protrusion 85 mounted on the upper plate portion 61 of the bracket 60, a moving member 86 extending through the support pieces 81, 82 of the support block 65, and an elongated hole 41 formed in the support pieces 81, 82 for allowing a shaft portion 86*a* of the moving member 86 to be inserted therein in such a manner as to be movable in the width direction B.

The protrusion 85 has a proximal end 85*a* inserted into the upper plate portion 61 of the bracket 60 and mounted thereto, while the protrusion 85 has a distal end 85*b* having a cone shape with a gradually decreasing diameter. A head 86*b* of the moving member 86 has a diameter larger than the elongated hole 41 and has at its center a recess 86*c* for allowing the distal end 85*b* of the protrusion 85 to be brought into and out of engagement therewith. The moving member 86 has an end provided with a retaining member 86*d* for preventing the shaft portion 86*a* of the moving member 86 from falling from the elongated hole 41. A corresponding one of the opposite ends of the suction pipe 51 is located between the support pieces 81, 82 of the support block 65 and is integrally formed with a closing member 87 fitted around the shaft portion 86*a* of the moving member 86 for closing the corresponding one of the opposite ends of the suction pipe 51.

The plate supply device A has an auxiliary guide device 96 for guiding the printing plate 3 during the plate supply and discharge operations. The auxiliary guide device 96 includes a pivotally moving plate 97 supported at the opposite axial ends of the downstream sided front panel 10 via a support shaft 96*a*. The pivotally moving plate 97 includes a rod member 98 disposed at its leading end, supply plate guide rollers 99 mounted at intervals on the rod member 98 so as to contact the surface of the printing plate 3 only when the printing plate 3 is to be supplied, and discharge plate guide members (not shown) mounted on the rod member 98 between the adjacent supply plate guide rollers 99 for guiding the printing plate 3 by the contact therewith when the printing plate 3 is to be discharged. The pivotally moving plate 97 is designed to have different tilting angles relative to a horizontal plane P respectively for the plate supply operation and the plate discharge operation by using a link mechanism or the like (not shown). Specifically, the pivotally moving plate 97 is substantially parallel to the horizontal plane P in the plate discharge operation, and is tilted upward by an angle θ relative to the horizontal plane P in the plate supply operation. Thus, the pivotally moving plate 97 is pivotally moved to select whether the supply plate guide rollers 99 are to contact the printing plate 3 or the discharge plate guide members are to contact the printing plate 3 every time the operation is changed from the plate supply operation to the plate discharge operation or vice versa. The reason why such operation is to be made is to prevent ink of the printing plate 3 (used plate) from being attached to the printing plate 3 (new plate) during the plate supply operation. This operation allows ink to be attached only to the discharge plate guide members when in the plate discharge operation, while preventing the same from being attached to the supply plate guide rollers 99. This makes it possible to prevent ink from being attached to the newly supplied printing plate 3.

As illustrated in FIGS. 1 and 2, the printing section 1 has a plate discharge device 90 for discharging the printing plate 3 mounted on the plate cylinder 4 through an upper portion of the downstream sided front panel 10. The plate discharge device 90 is disposed on the rear side of the downstream sided front panel 10 and has a pair of plate-like discharge plate guide members 91, 92 disposed adjacent to each other so as to form a plate discharge passage 58 in a plate discharge direction C. The discharge plate guide members 91, 92 are fixed to the downstream sided front panel 10. The discharge plate guide members 91, 92 have lower portions bent away from each other to form an insertion opening 9*a* for ease of insertion of the printing plate 3 between the discharge plate guide members 91, 92, and upper portions disposed parallel to each other to form a plate discharge opening 9*b* at the upper end.

The plate discharge device 90 has clamping rollers 93, 94 for clamping the printing plate 3 from the front and rear sides (opposite sides), both acting as a transfer member. The clamping roller 94 is designed to be shiftable between a plate insertion position D1 at which the clamping roller 94 is moved away from the clamping roller 93 to allow the printing plate 3 to be inserted therebetween, and a clamping position D2 at which the clamping roller 94 is moved close to the clamping roller 93 to clamp the printing plate 3 therebetween.

The plate discharge device 90 has a cylinder device (air cylinder device) 68 as an extendable device for supporting the clamping rollers 93, 94 reciprocatingly movably along the plate discharge passage 58. The clamping roller 93 is rotatably supported via a support shaft 93*a* by a mounting member 67 mounted to the leading end of a rod 76 of the cylinder device 68. The clamping roller 94 is rotatably supported via a pin 77*a* by a leading end of an arm 77. The arm 77 is pivotally movably mounted to a middle portion of the mounting member 67 via a pin 67*a*.

The plate discharge device 90 has a shifting means 59 for shifting the clamping rollers 93, 94 from the plate insertion position D1 to the clamping position D2 or vice versa. The shifting means 59 is made up of the arm 77,a coil spring (tension spring) 78 for spring urging the clamping roller 94 towards the clamping roller 93, and a stay 79 having a rectangular cross section allowing the clamping roller 94 to come into and out of engagement with the stay 79 through an outer circumference of the clamping roller 94. The stay 79 is fixed to a lower portion of the discharge plate guide member 92. The coil spring 78 has one end held by the pin 77*a* and another end held by the pin 67*b* disposed at the leading end of the mounting member 67.

The plate discharge device 90 has a moving distance addition means 88 for allowing the printing plate 3, which is kept in contact with the clamping rollers 93, 94 or is in this case kept in clamped state with the clamping rollers 93, 94 to be moved in the plate discharge direction C through a distance obtained by adding a given distance to the distance corresponding to the stroke length (the length of the reciprocating stroke) of the rod 76 of the cylinder device 68. As the moving distance addition means 88, a rack and pinion mechanism is used, which is made up of a rack 29 disposed parallel to the axial direction of the cylinder device 68 and having a given length, and a pinion 47 to mesh with the rack 29 disposed on the circumference of the support shaft 93*a*. The rack 29 is fixed to a lower portion of the discharge plate guide member 91.

Now, the description will be made for the mounting operation to mount the printing plate 3 on the plate cylinder 4 in the thus arranged printing section 1. In this case, the operator inserts the printing plate 3 into a clearance between the front side of the downstream sided front panel 10 and the printing plate guide rod 45 while holding the printing plate guide plate 31 at the printing plate setting position C1 at which the opening 30 is closed. The printing plate 3 is held in position by bringing the engaged portions (the cutouts 27, 28) formed in the leading edge 20 of the printing plate 3 into engagement with the positioning members (the protrusions 42*a*, 42*b*) of the receiving frame member 42. Then, the printing plate 3 is moved downward so as to be inserted into a clearance between the front side of the downstream sided front panel 10 and the printing plate guide rod 46 and hence has the leading edge 20 inserted between the printing plate guide plate 31 and the receiving frame member 42.

Then, the operator operates a suction switch (not shown) to drive the suction pump of the sucker 50, thereby transmitting a suction force of the suction pump to the respective suction nozzles 52 via the suction pipe 51 so as to suck the rear surface of the printing plate 3, allowing a portion of the printing plate 3 close to the leading edge 20 to be held along the printing plate guide plate 31. In this case, the suction pipe 51 is positioned in the upper regions of the elongated holes 40 and therefore the suction nozzles 52 are also held at the suction position E1 that lies in these upper regions.

Then, the operator operates a plate supply switch (not shown) to stop the leading-edge clamping member 21 at a position at which the leading edge 20 of the printing plate 3 is to be inserted, and subsequently drive the cylinder devices 36 with a periphery of the leading edge 20 of the printing plate 3 held along the printing plate guide plate 31 so that the printing plate guide plate 31, which has been closing the opening 30 until then, is pivotally moved towards the plate cylinder 4 around the support shaft 31*a* (in an anticlockwise direction of FIG. 1) and then shifted to the printing plate supply position C2. By this motion, the leading edge 20 of the printing plate 3 is moved close to the clamping gripper 15, specifically the leading-edge clamping member 21, of the plate cylinder 4. On the other hand, along with the pivotal motion of the printing plate guide plate 31 towards the plate cylinder 4, the pivotally moving plate 97 of the auxiliary guide device 96, which has been substantially horizontally held until then, is pivotally moved by an angle θ relative to the horizontal plane P as represented in phantom lines so as to allow the rod member 98 disposed at the leading end of the pivotally moving plate 97 to move closer to the leading edge 20 on the printing plate guide plate 31.

Then, the cylinder device 37 is driven to extend the rod 62, which allows the support block 65 to move towards the stopper 70 along the printing plate guide plate 31 through the body 80 mounted to the rod 62. On the other hand, the protrusion 85, which has been held in engagement with the head 86*b* of the moving member 86 until then, is released from the engagement with the same, and the sucker 50 is moved to the plate supply position E2 at which the suction nozzles 52 are positioned in the lower regions of the elongated holes 40. That is, with the arrangement in which the suction pipe 51 is mounted to the support block 65 via the moving member 86 and the closing member 87, and the suction nozzles 52 are mounted to the suction pipe 51, the suction nozzles 52 move to the leading-edge clamping member 21 of the clamping gripper 15 along the elongated holes 40 while holding the printing plate 3 by the suction force when the support block 65 moves towards the stopper 70 along the printing plate guide plate 31.

When the sucker 50 has moved to the plate supply position E2 with the printing plate 3 positioned correctly relative to the plate cylinder 4 in the width direction B, the cutouts 27, 28 formed in the leading edge 20 of the printing plate 3 are respectively engaged with the protrusions 25, 26 of the leading-edge clamping member 21. Upon the engagement of the cutouts 27, 28 of the leading edge 20 of the printing plate 3 with the protrusions 25, 26 of the leading-edge clamping member 21, the cylinder device 37 stops further extension of the rod 62 by a load resulting from the engaging force, and in this state, the leading-edge clamping member 21 is driven to clamp the leading edge 20 of the printing plate 3.

Thus, with the cutouts 27, 28 of the printing plate 3 held in engagement with the protrusions 25, 26 of the leading-edge clamping member 21, the cylinder device 37 stops before the support block 65 contacts the stopper 70 so that the sucker 50 moves to a given plate supply position E2 and stops its further movement, even if the support block 65 moves towards the stopper 70 along the printing plate guide plate 31. However, in such a case where the operator erroneously operates the suction switch when the printing plate 3 is not inserted in the clearance between the front side of the downstream sided front panel 10 and the receiving frame member 42, the cutouts 27, 28 of the printing plate 3 do not engage with the protrusions 25, 26 of the leading-edge clamping member 21 and therefore the rod 62 keeps its extending motion with no load applied to the cylinder device 37. This extension of the rod 62 of the cylinder device 37 is however stopped by the application of a load to the cylinder device 37, which results from the contact of the support block 65 with the stopper 70.

Now, the description will be made for the case where the printing plate 3 is not correctly positioned relative to the plate cylinder 4 in the width direction B. In this case, the cutouts 27, 28 are out of alignment with the protrusions 25, 26 in the width direction B and therefore they are unlikely to be engaged with each other. In order to address this problem, the block positioning mechanism 72 is provided at each of the opposite ends of the sucker 50. That is, the block positioning mechanism 72 at each end has the elongated hole 41 in the support pieces 81, 82 for allowing the shaft portion 86*a* of the moving member 86 to be inserted thereinto while being movable in the width direction B, and the protrusion 85 is positioned away from the head 86*b* of the moving member 86 so that the moving member 86 is held in such a manner as to be movable along the elongated hole 41 at the plate supply position E2 of the sucker 50.

With the thus arranged positioning mechanism 72 provided at each end of the sucker 50, when the leading edge 20 of the printing plate 3 has been moved towards the leading-edge clamping member 21 at the printing-plate supply position C2 at which the printing plate guide plate 31 has been pivotally moved towards the clamping gripper 15 so as to open the opening 30, the cutouts 27, 28, which happened to be out of alignment with the protrusions 25, 26 in the width direction B, are brought into alignment with the same, as long as a slight engagement or only a kind of hooking engagement (not requiring a full engagement) is present between the outer circumferences 25*a*, 26*a* of the cylindrical protrusions 25, 26 and the lateral side walls 27*a*, 28*a* of the cutouts 27, 28, which engagement causes the protrusions 25, 26 to press the lateral side walls 27*a*, 28*a* of the cutouts 27, 28, thus bringing the cutouts 27, 28 into alignment with the protrusions 25, 26 and hence allowing the printing plate 3 to be mounted at a correct position relative to the plate cylinder 4 in the width direction B.

Then, the suction nozzles 52, which together suck the printing plate 3 and hold the same tightly, allow themselves and the suction pipe 51 to move along with the printing plate 3 towards the leading-edge clamping member 21, while moving in the width direction B, so that the leading edge 20 of the printing plate 3 is clamped by the driving of the leading-edge clamping member 21. Meanwhile, it is assumed that, even if the printing plate 3 is not mounted at a correct position relative to the plate cylinder 4 in the width direction B, the displacement therebetween is generally small. Therefore, even with a slight engagement or only a kind of hooking engagement (not requiring a full engagement) between the cutouts 27, 28 and the protrusions 25, 26, the protrusions 25, 26 can press through their outer circumferences the lateral side walls 27*a*, 28*a* of the cutouts 27, 28 so that the printing plate 3 can be correctly positioned with respect to the width direction B.

The anticlockwise rotation (FIG. 1) of the plate cylinder 4 with the leading-edge clamping member 21 driven and having been clamping the leading edge 20 of the printing plate 3 causes the printing plate 3 to be mounted on the plate cylinder 4. At this moment, the pivotally moving plate 97 is pivotally moved upward by the angle θ relative to the horizontal plane P, and therefore allows the printing plate 3 to be guided along the supply plate guide rollers 99 disposed on the pivotally moving plate 97. Then, the trailing-edge clamping member 23 of the clamping gripper 15 clamps the trailing edge 22 of the printing plate 3, allowing the printing plate 3 to be tightly mounted on the plate cylinder 4. Thus, the printing section is set in a state for starting a printing operation. On the other hand, once the mounting operation of the printing plate 3 on the plate cylinder 4 has been finished, the cylinder device 37 is again driven to have its rod 62 return towards the cylinder portion 73. Whereby, the sucker 50 entirely moves upward; the suction nozzles 52 return to the suction position E1 at which they suck the printing plate 3 to be subsequently supplied; the protrusion 85 of the block positioning mechanism 72 at each end of the sucker 50 engages with the head 86*b* of the moving member 86; and the sucker 50 is entirely fixed in position in such a manner as to be non-movable relative to the width direction B. Substantially at the same time, the printing plate guide plate 31 returns from the printing plate supply position C2 to the printing plate setting position C1 by the driving of the cylinder devices 36. At this moment, the pivotally moving plate 97 returns to its original positions at which it is held in the substantially horizontal orientation.

Now, the description will be made for the printing plate discharge operation of the plate discharge device 90 after the finish of the printing. When the printing has been finished, the cylinder device 68 is held with the maximum extension of the rod 76, as illustrated in FIG. 7. Therefore, the mounting member 67 is located at a lowermost position closest to the insertion opening 9*a*. Since the mounting member 67 is located at the lowermost position, the pinion 47 of the support shaft 93*a* of the clamping roller 93 is held in meshed engagement with the rack 29 at the lowermost position. The clamping roller 94 also contacts the stay 79 at the lowermost position and is pressed with the stay 79 against the spring force of the coil spring 78 so that an angle between a center line 67*c* of the mounting member 67 and a center line 77*b* of the arm 77 becomes large. Thus, the clamping roller 94 is held at the plate insertion position D1 with a distance from the clamping roller 93.

Upon the finish of the printing, a control device (not shown) controls the plate cylinder 4 to rotate so as to return the clamping gripper 15 to a given position according to needs and circumstances, and release the trailing-edge clamping member 23 from its claming engagement with the trailing edge 22 of the printing plate 3. Whereby, the trailing edge 22 of the printing plate 3 is removed away from the plate cylinder 4 via the spring force of the printing plate 3 and brought into engagement with the discharge plate guide members of the pivotally moving plate 97 held in the substantially horizontal orientation. Then, the plate cylinder 4 is rotated in a clockwise direction of FIG. 2, thereby moving a portion of the printing plate 3 subsequent to the trailing edge 22 away from the plate cylinder 4 and hence allowing the trailing edge 22 of the printing plate 3 to be drawn into the insertion opening 9*a* between the discharge plate guide members 91, 92 and then drawn between the clamping rollers 93, 94.

The plate cylinder 4 is further rotated in the clockwise direction of FIG. 2 to release the leading-edge clamping member 21 from the clamping state at a given position. Whereby, the rod 76 of the cylinder device 68, which has been held in an extension state, starts to retract (move upward), and the arm 77 is withdrawn by the spring restoring force of the coil spring 78, so that the clamping roller 94 moves towards the clamping roller 93 in such a direction as to decrease the angle between the center line 67*c* of the mounting member 67 and the center line 77*b* of the arm 77, as rotating on an upper surface (contacting surface) 79*a* of the stay 79. Then, as illustrated in FIG. 8, when the rod 76 further retracts, the clamping roller 94 moves closer to the clamping roller 93 into the clamping position D2 at which the clamping rollers 93, 94 together clamp the middle portion of the printing plate 3 from the opposite sides. At this moment, the clamping roller 94 is urged towards the clamping roller 93 by the spring force of the coil spring 78 so that the printing plate 3 can be securely clamped from the opposite sides.

As the rod 76 further retracts, the printing plate 3 is moved upward along the discharge plate guide members 91, 92 while being clamped by the clamping rollers 93, 94. At this moment, since the rack 29 is held in meshed engagement with the pinion 47, the clamping roller 93 is rotated in an anticlockwise direction of FIG. 9 along with the rotation of the pinion 47, as being moved upward. On the other hand, the clamping roller 94, which is urged towards the clamping roller 93 by the spring force of the coil spring 78, starts to rotate upon receiving the rotational force via the printing plate 3. Thus, the printing plate 3 is transferred in the plate discharge direction C by the rotation of both the clamping rollers 93, 94. That is, the printing plate 3 clamped by the clamping rollers 93, 94 moves by a distance not equal to the retract distance of the rod 76 of the cylinder device 68 in the backward stroke, but a distance equal to the sum of this retract distance of the rod 76 and the linear distance corresponding to the rotational distance of the clamping rollers 93, 94, when being transferred in the plate discharge direction.

The printing plate 3 thus transferred in the plate discharge direction C is, for example, manually taken out through the body cover 2 to the outside by the operator. After taken out of the printing plate 3, the cylinder device 68 is driven to extend the rod 76 so as to move downward the clamping rollers 93, 94. Upon contact of the clamping roller 94 with the stay 79, the clamping roller 94 is pressed by the stay 79 so as to be pivotally moved around the pin 67*a* of the mounting member 67, thereby increasing the angle between the center line 67*c* of the mounting member 67 and the center line 77*b* of the arm 77. Hence, the clamping roller 94 returns to the plate insertion position D1 with a distance from the clamping roller 93.

In a prior art, when the printing plate 3 is to be transferred in the plate discharge direction C by a sufficient amount, it is necessary to use a cylinder device with a large stroke length of a rod, which leads to increase in the entire size of the plate discharge device. However, according to this embodiment of the present invention, the backward stroke of the rod 76 for discharging the printing plate 3 causes the clamping roller 93 to rotate along with the pinion 47 held in meshed engagement with the rack 29 so that the linear distance corresponding to the rotational distance is added to the retract distance of the rod 76. Therefore, it is not necessary to use a cylinder device with a large stroke length of a rod, while it is possible to transfer the printing plate 3 in the plate discharge direction C by a distance sufficient for plate discharging. As a result, a plate discharge (taking-out) operation can easily be made.

Although the cylinder device 68 was used as an extendable device in the above embodiment, it is not necessary to limit the present invention to this. For example, in place of the cylinder device 68, an additional rack and pinion mechanism may be provided. In this arrangement, a pinion is supported in position so as to be rotated by using a motor or a rotary air cylinder; a rack is disposed so as to be movable in the vertical direction (a direction along the plate discharge passage 58) by the rotational force of the pinion; and the mounting member 67 is mounted to this rack. The residual structure can be the same as that of the above embodiment. This arrangement with an additional rack and pinion mechanism employed in place of the cylinder device 68 can also limit increase in the entire size of the device while keeping its performance to transfer the printing plate 3 by a sufficient amount.

Although the rack and pinion mechanism was used as a moving distance addition means in the above embodiment, it is not necessary to limit the present invention to this. For example, in place of the rack and pinion mechanism, it is possible to employ another arrangement, in which a motor or rotary air cylinder is connected to the clamping roller 93 so as to rotate the same around the support shaft 93*a*, and this motor or rotary air cylinder is controlled to be driven along with the backward stroke of the rod 76 of the cylinder device 68. This arrangement can also limit increase in the entire size of the device while keeping its performance to transfer the printing plate 3 by a sufficient amount.

Although, in the above embodiment, the rack and pinion mechanism was provided on the side of the rod 76 as the moving distance addition means so that the clamping roller 93 is rotated along with the backward stroke of the rod 76, the rack and pinion mechanism may be provided not on the side of the rod 76 but on the side of a cylinder 68*a*. Specifically, a rack is provided on a lateral side of the cylinder 68*a*, and a pinion is supported in position so as to be meshed with this rack and rotated by a motor or a rotary air cylinder. This arrangement does not allow the clamping roller 93 to be rotated along with the backward stroke of the rod 76, but the moving distance of the cylinder 68*a* is added to the retract distance of the rod 76. Therefore, this arrangement can also limit increase in the entire size of the device while keeping its performance to transfer the printing plate 3 by a sufficient amount. In this arrangement, it is not necessary to limit the transfer member to a roller type member. The transfer member may be of such a shape allowing for clamping the printing plate 3 from the opposite sides through not rounded surfaces but flat surfaces. It can be said for all of the above embodiments that, since the increase in the entire size of the device can be limited, it is possible to prevent the downstream side of the ink fountain (not shown) from being closed, and hence prevent deterioration of the performance to operate the ink fountain.

Although the clamping rollers 93, 94 for clamping the printing plate 3 were used as the transfer member in the above embodiment, it is not necessary to limit the present invention to this. For example, the transfer member may be a retaining member for retaining the printing plate 3 at a given position. However, according to this arrangement, it may be hard to directly rotate the retaining member unlike the clamping rollers 93, 94. Therefore, as long as the rack and pinion mechanism is used as the moving distance addition means, it is necessary to use a mechanism for converting the rotational motion of the pinion 47 to the linear motion in the plate discharge direction C and adding the linear distance to the retracting distance of the rod 76 of the cylinder device 68.

In the above embodiment, in order to achieve the moving distance addition means, the pinion 47 is rotatably connected to the rod 76 of the cylinder device 68; the rack 29 is provided to be meshed with the pinion 47; and the clamping roller 93 is provided to be rotated integrally with the pinion 47. The moving distance addition means is not necessarily limited to this arrangement. For example, it is possible to employ an arrangement, in which a sprocket is used in place of the pinion 47, while a chain is used in place of the rack 29. Further, it is possible to employ an arrangement, in which a pulley is used in place of the pinion 47, while a timing belt is used in place of the rack 29. In either arrangement, it is possible to limit increase in the entire size of the cylinder device 6 while keeping its performance to transfer the printing plate 3 by a sufficient amount.

This specification is by no means intended to restrict the present invention to the preferred embodiments set forth therein. Various modifications to the printing press, as described herein, may be made by those skilled in the art without departing from the spirit and scope of the present invention as defined in the appended claims.

What is claimed is:

1. A printing press with a plate cylinder, on which a printing plate is to be mounted, comprising:

a clamping gripper being provided on the plate cylinder so as to clamp an edge of the printing plate; and a plate discharge device for moving the printing plate in a plate discharge direction with a trailing edge of the printing plate as a leading edge after the printing plate is released from a clamped relationship with the clamping gripper;

said plate discharge device comprising:

a plate guide member for forming a plate discharge passage in the plate discharge direction;

a transfer member disposed along the plate discharge passage for being brought into contact with a printing plate, which has been released from the clamped relationship with the clamping gripper, so as to transfer the printing plate in the plate discharge direction;

an extendable device for reciprocatingly moving the transfer member along the plate guide member through the length of the reciprocating stroke thereof; and a moving distance addition means for allowing the printing plate, which is kept in contact with the transfer member, to be moved in the plate discharge direction through a distance obtained by adding a given distance to the distance corresponding to the length of the reciprocating stroke of the extendable device.

2. The printing press according to claim 1, wherein said transfer member comprises a pair of clamping rollers for clamping the printing plate from the opposite sides thereof, and said printing press further comprises a shifting means for shifting the clamping rollers between a plate insertion position at which the clamping rollers are moved away from each other to allow the printing plate to be inserted therebetween, and a clamping position at which the clamping rollers are moved closer to each other to clamp the printing plate therebetween, along the reciprocating stroke of the extendable device.

3. The printing press according to claim 2, wherein the moving distance addition means comprises a pinion that is rotatably connected to an extendable part of the extendable device and a rack that is disposed in meshed engagement with the pinion, and at least one of the clamping rollers is disposed to be rotatable integrally with the pinion.

4. The printing press according to claim 1, wherein the extendable device comprises a cylinder device.

* * * * *